US005713748A

United States Patent [19]

Mulvihill

[11] Patent Number: 5,713,748

[45] Date of Patent: Feb. 3, 1998

[54] CABLE GROUNDING AND STRAIN RELIEF APPARATUS

[75] Inventor: Timothy M. Mulvihill, Lakeville, Mass.

[73] Assignee: EMC Corporation, Hopkinton, Mass.

[21] Appl. No.: 579,772

[22] Filed: Dec. 28, 1995

[51] Int. Cl.[6] ..... H01R 13/648

[52] U.S. Cl. ..... 439/98; 439/579

[58] Field of Search ..... 439/98, 99, 579, 439/394, 425, 785; 174/35 R

[56] References Cited

U.S. PATENT DOCUMENTS

| | | | |
|---|---|---|---|
| 3,568,128 | 3/1971 | Taylor | 439/98 |
| 4,261,632 | 4/1981 | Narozny | 339/97 |
| 4,561,179 | 12/1985 | Brush, Jr. et al. | 29/866 |
| 4,627,673 | 12/1986 | Barrus, Jr. | 339/14 R |
| 4,696,908 | 9/1987 | Gutter et al. | 439/98 |
| 4,708,414 | 11/1987 | Lam | 439/394 |
| 4,739,126 | 4/1988 | Gutter et al. | 174/65 |
| 4,808,121 | 2/1989 | Smrekar | 439/394 |
| 5,052,945 | 10/1991 | Shimomura et al. | 439/394 |
| 5,076,799 | 12/1991 | Virgo | 439/394 |
| 5,122,068 | 6/1992 | Koss | 439/98 |

OTHER PUBLICATIONS

IBM Technical Disclosure bulletin, "Compression/Solder Contact for Electromagnetic Compatibility Shielded Cable", vol. 39, No. 06. 439/98., Jun. 1996.

*Primary Examiner*—Gary F. Paumen

*Attorney, Agent, or Firm*—Wolf, Greenfield & Sacks, P.C.

[57] ABSTRACT

An panel-mounted apparatus for grounding the outer shield of an electrical cable to the panel, and simultaneously providing a strain relief for the cable. The apparatus includes a pair of grounding blocks, and a pair of grounding sleeves. Each grounding block has a channel for receiving a grounding sleeve. A first grounding block is mounted to an electronic enclosure, and a second grounding block is attached to the first grounding block so that the channels in each block align and form a cable receiving hole; the cable being secured in the hole between the grounding blocks. Each grounding sleeve includes a plurality of grounding blades which protrude radially from the sleeve into the cable receiving hole to slice the cable jacket and engage the cable shield to ground the shield to the enclosure. The sleeve can also include a locking finger at each end that is adapted to engage side walls of the grounding blocks adjacent the channel to reduce axial movement of the sleeves within the channel and provide a strain relief for the cable. Each grounding block can include a plurality of channels for simultaneously grounding a plurality of cables.

16 Claims, 5 Drawing Sheets

CABLE GROUNDING AND STRAIN RELIEF APPARATUS

BACKGROUND OF THE INVENTION

1. Field of the Invention

The present invention relates to an apparatus for terminating electrical cables, and more particularly to a panel-mounted apparatus for grounding the outer shield of a cable to the panel while simultaneously providing a strain relief for the cable.

2. Description of the Related Art

A common problem associated with the use of electronic equipment is the generation of electro-magnetic interference (EMI) which can detrimentally affect the operation of electronics. EMI problems can be reduced by shielding the electronics with a grounded enclosure so that interference generated by the electronics can be dissipated to ground through the enclosure. A grounded enclosure can also block EMI generated by external electronic equipment so that it does not interfere with the operation of the electronics within the enclosure.

External electrical cables, e.g., signal and power cables, conventionally are used to interconnect separate pieces of electronic equipment for communication therebetween, and to connect the equipment to a power source for operating the electronics within an enclosure. External cables, however, can also become a source of EMI problems. Unless shielded, signals carried through cables can produce EMI which can interfere with the operation of electronics. Additionally, externally generated EMI can interfere with signals carried through a cable. Therefore, it is desirable to electrically connect a cable shield to a grounded enclosure to effectively shield the cable and reduce EMI problems. It is also often desirable to simultaneously ground and provide a strain relief for a plurality of cables.

Various devices and techniques have been used to ground a shielded cable to panels and enclosures, and to simultaneously provide a strain relief for the cable. Many of these devices were not satisfactory because they require the cable to be stripped or otherwise require the cable to be prepared for receipt of the grounding device, or they could not be used with fully assembled cables. Additionally, some of these devices used grounding prongs to pierce the cable jacket, which was difficult to control and unreliable.

In U.S. Pat. No. 4,627,673, Barrus, Jr., a shielded flat cable can be grounded by stripping back the outer jacket to expose the shield. Wedge plates are positioned above and below the cable, between the shield and jacket, and a housing is fitted over the wedge plates which clamp the jacket between the housing and wedge plates, and ground the shield to a panel through the wedges.

In U.S. Pat. No. 4,739,126, Gutter et al., a shielded cable can be grounded to a panel by compressing a tubular termination member around the cable driving prongs inwardly to pierce through the cable jacket. The apparatus uses an externally threaded housing mounted to a panel, a compression member which drives the prongs inwardly, and an internally threaded closure member which urges the compression member over the termination member. The apparatus grounds a single cable, of which a connector less end must be inserted through a series of axially aligned holes in the various parts.

SUMMARY OF THE INVENTION

Accordingly, it is an object of the present invention to provide an improved cable grounding apparatus that can simultaneously ground one or more shielded cables and provide a strain relief for the cables.

According to one aspect of the invention, an apparatus for grounding an electrical cable includes a pair of grounding blocks and a pair of grounding sleeves. Each grounding block has a channel extending across a face of the block, and each grounding sleeve includes a body adapted to nest within the channel of each grounding block. Each grounding sleeve also includes a plurality of blades extending radially inward from the body. Each grounding sleeve is disposed in a channel of a grounding block, and the pair of grounding blocks are attached to each other to secure a cable therebetween. The pair of grounding blocks are attached to each other with the channels facing each other to form a cable receiving hole. The plurality of blades protrude into the cable receiving hole to slice an outer jacket of a cable and engage a shield of the cable when the cable is urged into the channels as the pair of grounding blocks are attached to each other.

In one embodiment, each channel is semicircular, and each grounding sleeve body has a substantially semicircular cross-section. In another embodiment, each grounding block has a plurality of channels including a first channel and a second channel that form a first cable receiving hole having a first diameter and a second cable receiving hole having a second diameter that is greater than the first diameter. In other embodiments, each grounding sleeve includes a locking finger disposed on each end of the grounding sleeve body, and the locking finger can be disposed in each corner of the grounding sleeve body. In further embodiments, each grounding block includes a flange disposed in a top portion of the channel to abut the top edge of each grounding sleeve. Each flange can longitudinally extend along the channel. In still another embodiment, each of the plurality of blades has a cutting edge disposed in the cable receiving hole position transversely to the longitudinal axis of the cable receiving hole.

According to another aspect of the invention, a cable grounding and strain relief apparatus includes a pair of grounding blocks, each block having a channel extending across the block in an axial direction to form a cable receiving hole for securing a cable when the grounding blocks are attached to each other, and a plurality of blades extending radially inward from each grounding block to protrude into the cable receiving hole. The plurality of blades are adapted to slice through an outer jacket of the cable and electrically engage an outer conductor beneath the outer jacket. The plurality of blades are affixed to each grounding block to restrain movement of the cable in the axial direction.

According to a further aspect of the invention, a grounding sleeve for an electrical cable includes an elongated, semicircular body, and plurality of grounding blades. The body is curved around a longitudinal axis and each blade protrudes radially inward from the body toward the longitudinal axis. Each grounding blade has a cutting edge disposed at a tip of the blade which is positioned transverse to the longitudinal axis.

BRIEF DESCRIPTION OF THE DRAWINGS

It is to be understood that the drawings are for the purpose of illustration only and are not intended as a definition of the limits of the invention. The foregoing and other objects and advantages of the present invention will become apparent with reference to the following detailed description when taken in conjunction with the following drawings in which.

DETAILED DESCRIPTION OF THE INVENTION

Figure 1:
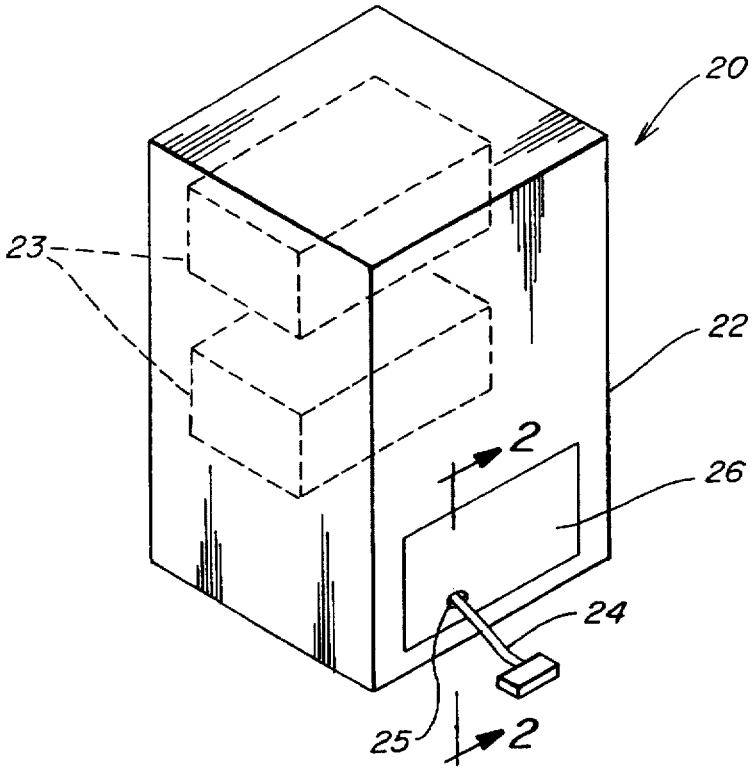
FIG. 1 is a perspective view of an electronic assembly.
Figure 2:
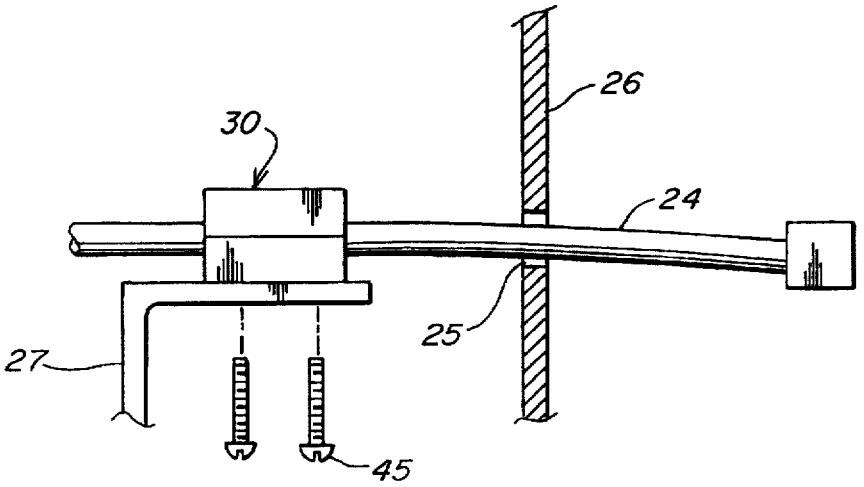
FIG. 2 is a partial cross-sectional view taken along section line 2—2 of FIG. 1 illustrating the apparatus of the present invention mounted to a panel of an enclosure.

The present invention is directed to an apparatus for grounding a shielded cable to the panel of an electronic cabinet, and for simultaneously providing a strain relief for the cable. As illustrated in FIG. 1, an electronic assembly 20 can include an electronic enclosure 22 (e.g., a cabinet), in which is mounted electronic subassemblies 23 or components, and at least one cable 24, which passes through an opening 25 in a panel 26 of the enclosure 22 to interconnect the electronic assembly 20 to other electronic equipment or devices. To suppress EMI generated within the electronic assembly 20 that could interfere with the operation of other electronic equipment, the enclosure 22 is grounded and the cable 24 is covered with a shield that can be grounded to the enclosure 22. As shown in FIG. 2, the cable 24 is grounded to the enclosure 22 using a cable grounding apparatus 30, which can be mounted to a bracket 27 or enclosure frame inside the enclosure, preferably in a location that is accessible through a panel or door. The cable 24 is secured to the apparatus 30 in such a manner that the cable shield is electrically connected to the apparatus to establish an electrical path between the cable shield and the enclosure through which electro-magnetic noise carried on the shield is dissipated to ground.

Figure 3:
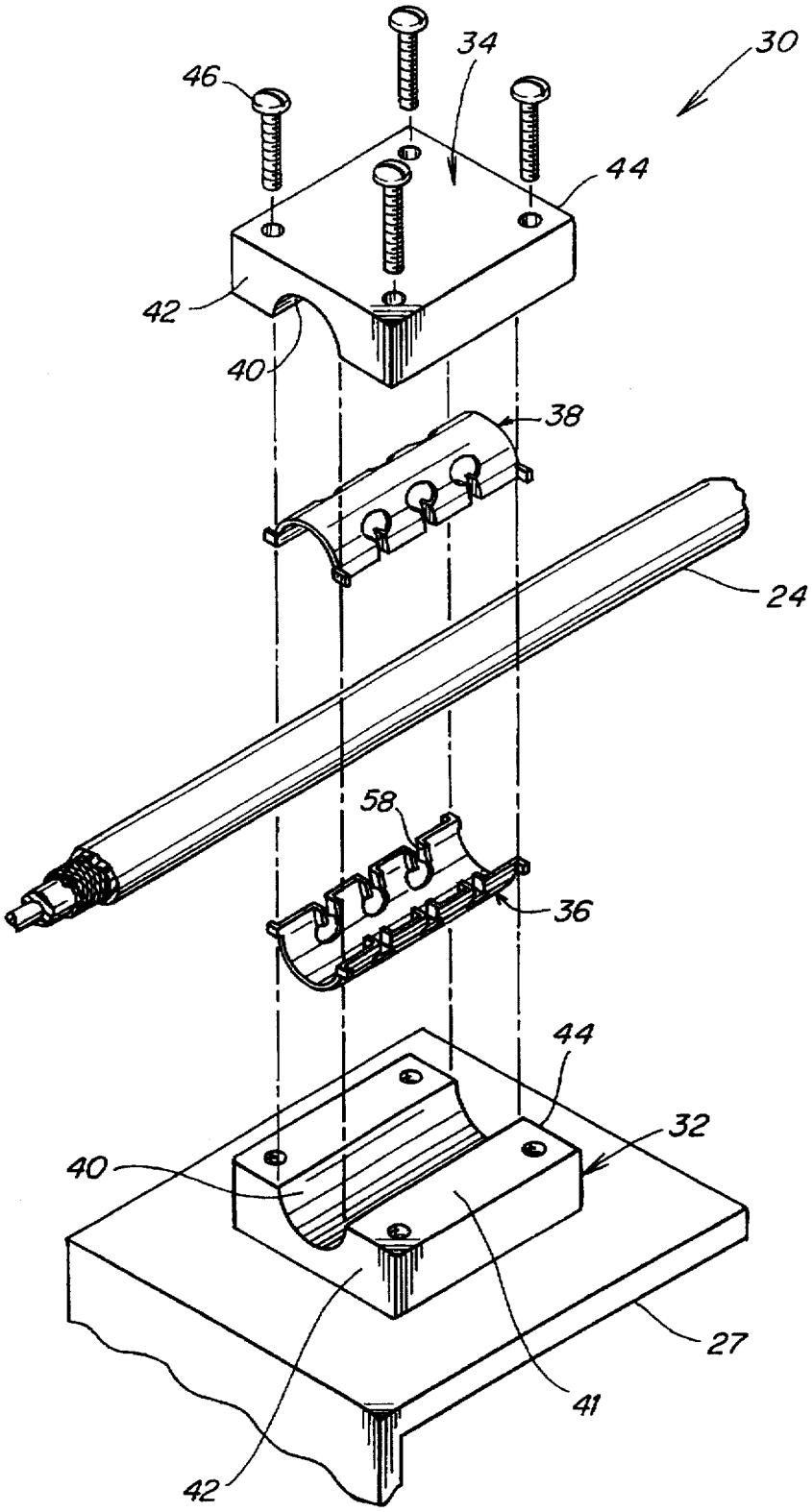
FIG. 3 is an exploded perspective view of an embodiment of the apparatus of the present invention.
Figure 4:
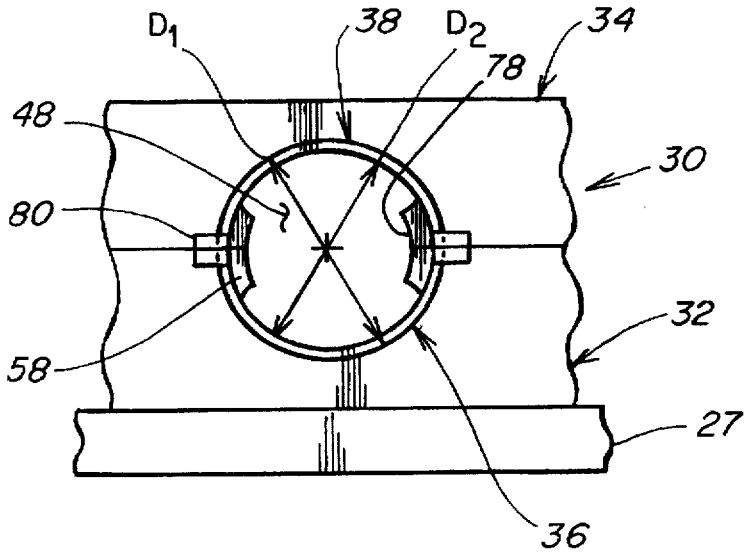
FIG. 4 is a partial side elevational view of the apparatus of FIG. 3 assembled without a cable.

As illustrated in FIG. 3, the cable grounding apparatus 30 includes a pair of grounding blocks 32, 34, and a pair of grounding sleeves 36, 38. Each grounding block has at least one open-ended channel 40 disposed across a face 41 of the block, and which extends from one side 42 of the block to an opposite side 44 of the block. Each of the grounding sleeves 36, 38 is adapted to nest within and conform to the shape of the channels 40. A lower grounding block 32, is attached to the bracket 27 using fasteners 45 (e.g., screws) (FIG. 2) with the channel 40 facing away from the bracket 27 and toward the enclosure interior. A lower grounding sleeve 36 is placed in the channel 40 of the lower block 32 so that it also faces away from the panel 26 and toward the enclosure interior. Similarly, an upper grounding sleeve 38 is placed in the channel 40 of an upper grounding block 34, which is positioned relative to the lower grounding block 32 so that the channels 40 are aligned to face each other. The cable 24, which is to be grounded to the enclosure 22, is secured between the lower grounding block 32 and sleeve 36 and the upper grounding block 34 and sleeve 38 by attaching the upper grounding block 34 to the lower grounding block 32 using fasteners 46 (e.g., screws). When the blocks 32, 34 are attached to each other, the aligned channels 40 form a cable receiving aperture or hole 48 (FIG. 4) through the grounding apparatus 30. Preferably, each grounding block 32, 34, and each grounding sleeve 36, 38 are identical parts that can be used interchangeably as either a lower or upper part in the apparatus.

Figure 5:
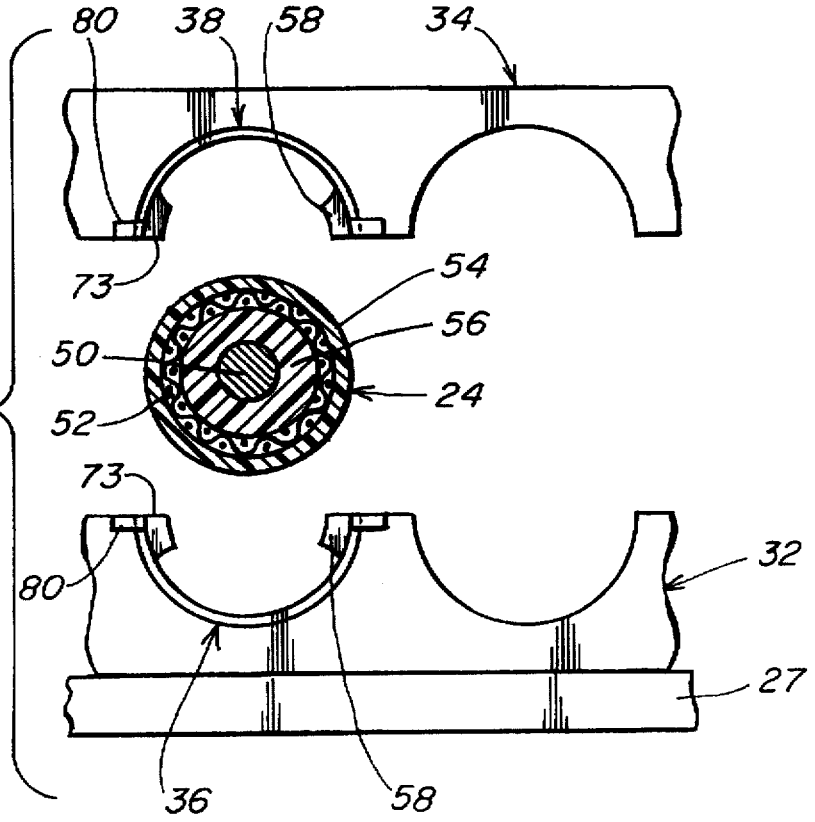
FIG. 5 is a partially exploded side elevational view of the apparatus of FIG. 3.

As shown in FIG. 5, a shielded cable 24 generally comprises an inner conductor 50, which can include a plurality of discrete wires, an outer conductor 52, which can include one or more tubular-shaped braided conductors, and a protective outer jacket 54 of insulating material. The outer conductor 52 surrounds the inner conductor 50, and the outer jacket 54 encompasses the outer conductor 52. Generally, an insulating layer 56 is disposed between the inner conductor 50 and the outer conductor 52. The outer conductor 52 functions as an electro-magnetic shield to reduce electro-magnetic coupling between the signals carried on the inner conductor 50 and the surrounding environment. It is to be appreciated that this cable construction is exemplary and the cable ground apparatus 30 can be used to ground shielded cables having various configurations.

Figure 6:
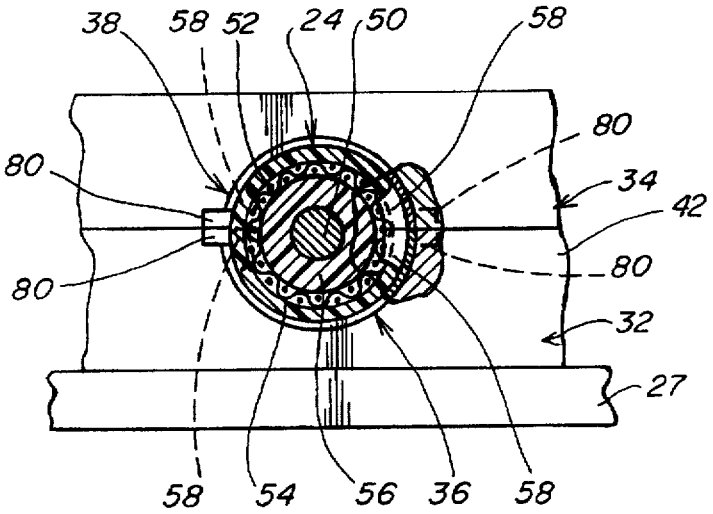
FIG. 6 is a partial side elevational view of the apparatus of FIG. 3 illustrating a cable being grounded by the apparatus.

In the conventional manner, the cable ground apparatus 30 dissipates electro-magnetic noise on the outer conductor (shield) 52 by establishing an electrical path between the shield 52 and an enclosure frame, assuming the frame is electrically grounded. As illustrated in FIGS. 5 and 6, as the upper grounding block 34 is attached to the lower grounding block 32, the cable 24 is squeezed between the upper and lower grounding sleeves 38, 36. A plurality of blades 58, which .protrude from the grounding sleeves 36, 38 into the cable receiving hole 48 (FIG. 4) formed by the channels 40, slice through the outer jacket 54 of the cable and engage the cable shield 52 beneath the jacket as the cable is urged into the channels, thereby creating an electrical connection between the shield 52 and the grounding sleeves 36, 38. Due to the intimate contact between the grounding sleeves 36, 38 and the grounding blocks 32, 34, both being made from electrically conductive materials, an electrical connection is established between the sleeves and blocks. The electrical path to the enclosure frame is completed through the interface between the lower grounding block 32 and the bracket 27, when the lower grounding block 32 is attached to the bracket 27.

Figure 7:
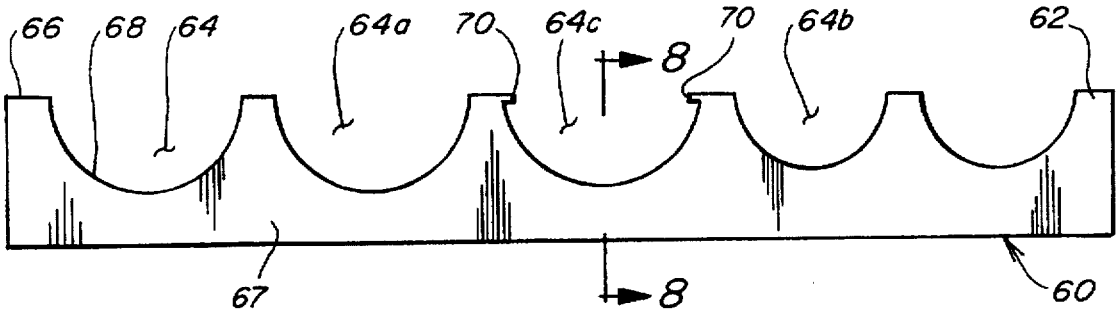
FIG. 7 is a side elevational view of an illustrative embodiment of a grounding block for use with the apparatus of the present invention.
Figure 8:
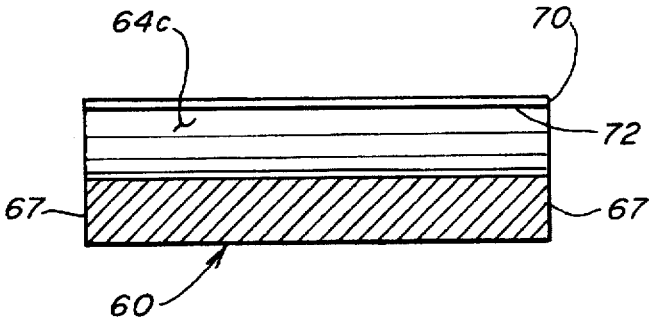
FIG. 8 is a cross-sectional view of the grounding block taken along section line 8—8 in FIG. 7.

As illustrated in FIGS. 7 and 8, another embodiment of a grounding block 60 includes a body 62 which has a plurality of elongated channels 64 disposed across a face 66 of the body 60 and longitudinally extending between opposite sides 67 of the body. Each channel 64 is open ended and preferably has a semicircular or U-shaped surface 68 that closely conforms to the shape of a round cable. Although the grounding block 60 can be made with one channel 64, as illustrated in FIG. 3, each block 60 is preferably made with a plurality of channels 64, as illustrated in FIGS. 7 and 8 to accommodate the grounding requirements of electronic assemblies which may include a plurality of interconnection cables. Furthermore, the plurality of channels 64 can include channels **64*a*, 64*b*, 64*c* having different sizes to allow the grounding apparatus to be used to ground cables having various diameters. The block 60 may also include that form a shoulder 72 to abut the top edges 73 (FIG. 10) of a grounding sleeve and retain the sleeve in a channel. Each flange 70 is coplanar with the face 66** of the block and a pair of flanges protrude inwardly from opposite sides and along the length of the channel.

One embodiment of the grounding block can be machined or cast from an aluminum material and finished with an electrically conductive coating, preferably a conductive anodic coating, such as chemical film, gold iridite, copper-nickel, and the like. The grounding block should be stiff so that it does not deflect when subjected to forces created when the upper block is attached to the lower block to secure the cable, thereby ensuring that the cable shield is grounded. It is to be appreciated that other conductive materials and finishes can be used for the grounding block, and the block can be manufactured using other processes.

Figure 9:
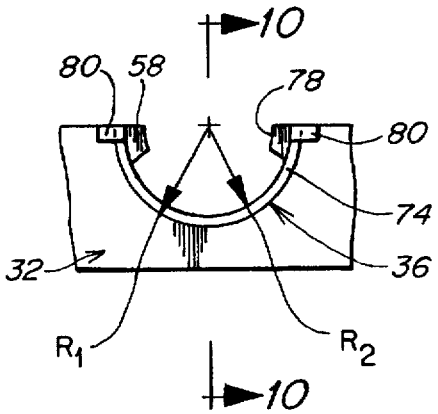
FIG. 9 is an end view of a grounding sleeve of the present invention mounted on a grounding block.
Figure 10:
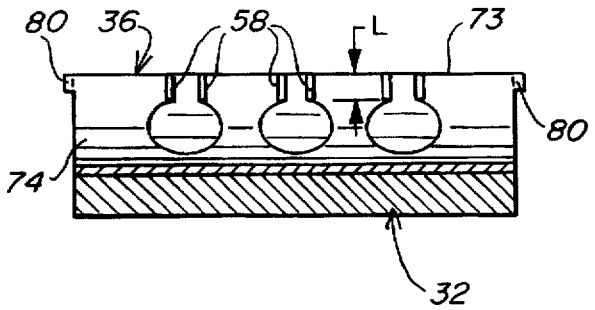
FIG. 10 is a cross-sectional view of the grounding sleeve taken along section line 10—10 in FIG. 9.
Figure 11:
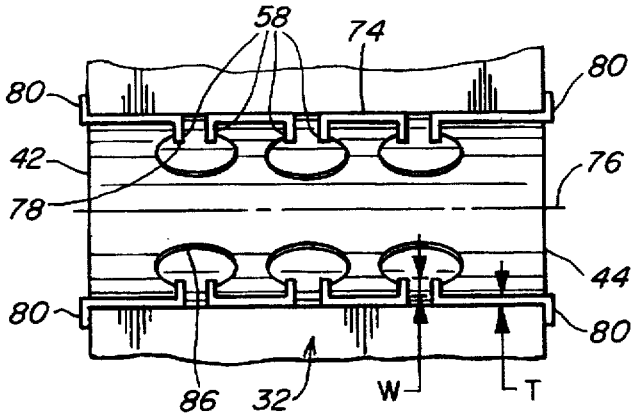
FIG. 11 is a top plan view of the grounding sleeve of FIG. 9.

As shown in FIGS. 9–11, a preferred embodiment of a grounding sleeve 36, 38 includes an elongated, semicircular or U-shaped body 74 made from a sheet of electrically conductive material, and a plurality of grounding blades 58 protruding radially inward from the body 74 and transverse to a longitudinal axis 76. Each blade 58 has a cutting edge 78 for slicing through a cable jacket to engage a cable shield, when the cable is urged between the grounding blocks 32, 34, 60. Each sleeve also includes a locking finger 80 protruding radially outward from each corner of the body. The locking fingers 80 are adapted to engage the side walls 42, 44, 67 of the grounding blocks adjacent each end of the channel to restrict axial movement of the grounding sleeves within the channel. Accordingly, the blades 58 work in conjunction with the locking fingers 80 to restrict axial movement of the cable when it is secured between the blocks and sleeves, thereby providing a strain relief for the cable.

Figure 12:
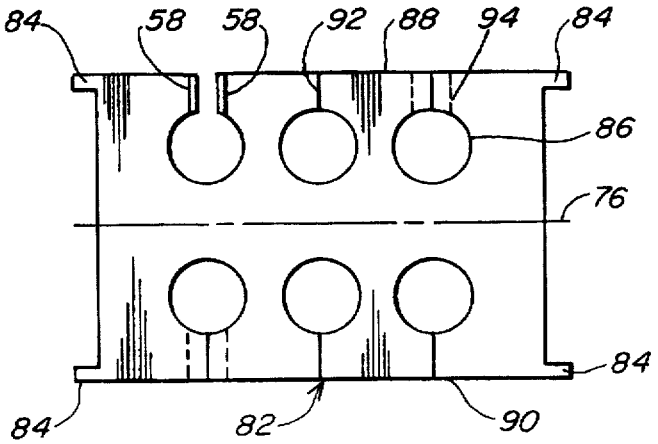
FIG. 12 is a plan view illustrating a sheet of material used to produce a grounding sleeve of the present invention.

As illustrated in FIG. 12, each grounding sleeve 36, 38 is made from a unitary sheet 82 of metal having a generally rectangular shape. The sheet 82 includes tabs 84 at each corner which form the locking fingers 80 when folded accordingly. Stress relief holes 86 are provided along the length of the sheet and spaced inwardly from opposite sides 88, 90 of the sheet. A plurality of cuts 92 are made in the sheet extending from the sides 88, 90 of the sheet inwardly to each stress relief hole 86. A pair of blades 58 is formed at each cut 92 by folding opposite portions of the sheet adjacent the cut along fold lines 94 which are parallel to and spaced from the cut. The stress relief holes 86 reduce the possibility of developing stress fractures or tearing when the blades are formed along the fold lines. The grounding sleeve is formed into a semicircular or U-shape by bending the sheet sides 88, 90 around the longitudinal axis 76 of the sleeve which coincides with the axis of curvature of a channel in a grounding block.

As illustrated, the grounding sleeve includes six pairs of blades 58, three pairs being disposed on each side of the sleeve, it is to be appreciated that the sleeve can be formed with various numbers of blades. However, more blades, as opposed to less blades, are generally more reliable in assuring that a proper electrical connection will be maintained between the cable shield and the sleeve. Preferably, the grounding sleeve is made from a copper material that is shaped to closely conform to a channel. The sleeve can be formed with a radius that is greater than the channel radius so that the sides of the sleeve are compressed inwardly when the sleeve is placed in a channel. The compression creates a spring-like effect such that the sides of the sleeve are urged outwardly against the channel surface to ensure an electrical connection between the sleeve and channel surface.

One illustrative embodiment of the cable grounding apparatus can be used to ground a shielded cable having an outer diameter of 0.49 inches. The channels in the lower and upper grounding blocks have a radius $R_1$ (FIG. 9) of 0.25 inches so that the assembled blocks form a cable receiving hole having a diameter $D_1$ (FIG. 4) of 0.50 inches. The grounding sleeves also have a radius $R_2$ (FIG. 9)of approximately 0.25 inches, and a thickness T (FIG. 11 ) of 8 mils. Therefore, when the sleeves are placed in the channels, the cable receiving hole has an effective diameter $D_2$ (FIG. 4) of approximately 0.484 inches. This creates a snug fit between the cable and grounding sleeves producing a radial force sufficient to maintain adequate electrical connections between the cable shield, grounding sleeves, and grounding blocks. The blades 58 are formed to have an edge length L (FIG. 10) of approximately 0.093 inches, and they protrude inwardly from the body of the sleeve a width W (FIG. 11) of approximately 0.062 inches to ensure that the blades slice through the cable jacket to engage the cable shield. However, it is to be appreciated that these dimensions are exemplary for one particular application, and that the grounding block and sleeve can be configured to accommodate cables having other diameters.

Having thus described particular embodiments of the invention, various alterations, modifications, and improvements will readily occur to those skilled in the art. Such alterations, modifications, and improvements are intended to be part of this disclosure, and are intended to be within the spirit and scope of the invention. Accordingly, the foregoing description is by way of example only and is limited in the following claims and the equivalents thereto.

What is claimed is:

1. An apparatus for grounding an electrical cable including a shield surrounding a conductor, and an outer jacket covering the shield, the apparatus comprising:

a pair of grounding blocks, each grounding block having a channel extending across a face of the block; and a pair of grounding sleeves, each grounding sleeve including a body adapted to nest within the channel of each grounding block, and a plurality of blades extending radially inward from the body, wherein each grounding sleeve is disposed in a channel of one of the grounding blocks and the pair of grounding blocks are attached to each other to secure a cable therebetween, the pair of grounding blocks being attached to each other with the channels facing each other to form a cable receiving hole having a longitudinal axis, the plurality of blades protruding into the cable receiving hole to slice an outer jacket of the cable and engage a shield of the cable when the cable is urged into the channels as the pair of grounding blocks are attached to each other.

2. The apparatus as recited in claim 1, wherein each channel is semicircular.

3. The apparatus as recited in claim 2, wherein each grounding sleeve body has a substantially semicircular cross-section.

4. The apparatus as recited in claim 1, wherein each grounding block has a plurality of channels.

5. The apparatus as recited in claim 4, wherein each grounding block has a first channel and a second channel that form a first cable receiving hole having a first diameter and a second cable receiving hole having a second diameter greater than the first diameter.

6. The apparatus as recited in claim 1, wherein each grounding sleeve includes a locking finger disposed on each end of the grounding sleeve body.

7. The apparatus as recited in claim 6, wherein each locking finger is adapted to engage a side wall of one of the grounding blocks adjacent the channel.

8. The apparatus as recited in claim 7, wherein each grounding sleeve includes one of the locking fingers disposed at each corner of the grounding sleeve body.

9. The apparatus as recited in claim 1, wherein each grounding block includes a flange disposed in a top portion of the channel to abut a top edge of each grounding sleeve.

10. The apparatus as recited in claim 9, wherein the flange longitudinally extends along the channel.

11. The apparatus as recited in claim 1, wherein each of the plurality of blades has a cutting edge disposed in the cable receiving hole positioned transversely to the longitudinal axis.

12. A cable grounding and strain relief apparatus comprising:

a pair of grounding blocks, each grounding block having a channel extending across the block in an axial direction, the grounding blocks being attached to each other with the channels aligned to form a cable receiving hole for securing a cable, the cable having an outer shielding conductor and an outer jacket covering the outer shielding conductor; and a plurality of blades extending radially inward from each grounding block and protruding into the cable receiving hole, the plurality of blades adapted to slice through the outer jacket of the cable and electrically engage the outer shielding conductor beneath the outer jacket, the plurality of blades affixed to each grounding block to restrain movement of the cable in the axial direction.

13. A grounding sleeve for an electrical cable, the grounding sleeve comprising:

an elongated, semicircular body having a longitudinal axis about which the body is curved; and a plurality of grounding blades, each grounding blade having a cutting edge disposed at a tip of the blade, each blade protruding radially inward from the body toward the longitudinal axis with the cutting edge being positioned transverse to the longitudinal axis.

14. The grounding sleeve as recited in claim 13, wherein the plurality of blades protrude toward the longitudinal axis from opposite sides of the body.

15. The grounding sleeve as recited in claim 13, further comprising a locking finger disposed on each end of the body.

16. The grounding sleeve as recited in claim 15, wherein each locking finger is disposed at a corner of the body.

* * * * *